US009897290B2

(12) United States Patent
Hsu

(10) Patent No.: US 9,897,290 B2
(45) Date of Patent: Feb. 20, 2018

(54) WALL LAMP

(71) Applicant: DONGGUAN JIA SHENG LIGHTING TECHNOLOGY COMPANY LTD, Dongguan (CN)

(72) Inventor: Shui-Sheng Hsu, Dongguan (CN)

(73) Assignee: DONGGUAN JIA SHENG LIGHTING TECHNOLOGY COMPANY LTD, Dongguan (CN)

( * ) Notice: Subject to any disclaimer, the term of this patent is extended or adjusted under 35 U.S.C. 154(b) by 0 days.

(21) Appl. No.: 15/239,801

(22) Filed: Aug. 17, 2016

(65) Prior Publication Data

US 2017/0299153 A1 Oct. 19, 2017

(30) Foreign Application Priority Data

Apr. 13, 2016 (CN) ..... 2016 2 0312399 U

(51) Int. Cl.

| | |
|---|---|
| ***F21V 17/02*** | (2006.01) |
| ***F21V 17/12*** | (2006.01) |
| ***F21V 1/00*** | (2006.01) |
| ***F21V 17/16*** | (2006.01) |
| ***F21V 3/00*** | (2015.01) |
| ***F21S 8/00*** | (2006.01) |
| *F21Y 115/10* | (2016.01) |

(52) U.S. Cl.

CPC ..... *F21V 17/02* (2013.01); *F21S 8/033* (2013.01); *F21V 1/00* (2013.01); *F21V 3/00* (2013.01); *F21V 17/12* (2013.01); *F21V 17/164* (2013.01); *F21Y 2115/10* (2016.08)

(58) Field of Classification Search

None

See application file for complete search history.

(56) References Cited

U.S. PATENT DOCUMENTS 4,277,820 A * 7/1981 Bostonian ..... F21S 8/02 362/223

2013/0088869 A1* 4/2013 Yun ..... F21V 29/004 362/249.01

* cited by examiner

*Primary Examiner* — Ashok Patel

(74) *Attorney, Agent, or Firm* — Platinum Intellectual Property LLP

(57) ABSTRACT

A wall lamp includes a main frame including a first side portion, a second side portion, a third side portion, and a fourth side portion that are connected to each other successively; a luminous component located in the main frame; a first blocking plate, a second blocking plate, a third blocking plate, and a fourth blocking plate positioned on the first side portion, the second side portion, the third side portion, and the fourth side portion, respectively; an upper blocking plate positioned on a top portion of the main frame; and a base assembled to a bottom portion of the main frame; wherein at least one of the first blocking plate, the second blocking plate, the third blocking plate, the fourth blocking plate, and the upper blocking plate is a detachable shielding plate.

10 Claims, 5 Drawing Sheets

WALL LAMP

FIELD OF THE INVENTION

The present disclosure relates to a technical field of lightings, and more particularly relates to a wall lamp.

BACKGROUND OF THE INVENTION

As one type of lightings, wall lamp is extensively applied to public places such as residential areas, tourist attraction, park, plaza, private garden, and courtyard corridor. However, the conventional wall lamp has an immobilized structural design, and a light emission angle or a light emission orientation of the wall lamp cannot be adjusted accordingly, thus it possesses a single function and a poor flexibility.

SUMMARY

Accordingly, it is necessary to provide a wall lamp which can realize an adjustment of a light emission angle or a light emission direction.

A wall lamp includes a main frame including a first side portion, a second side portion, a third side portion, and a fourth side portion that are connected to each other successively; a luminous component located in the main frame; a first blocking plate, a second blocking plate, a third blocking plate, and a fourth blocking plate positioned on the first side portion, the second side portion, the third side portion, and the fourth side portion, respectively; an upper blocking plate positioned on a top portion of the main frame; and a base assembled to a bottom portion of the main frame; wherein at least one of the first blocking plate, the second blocking plate, the third blocking plate, the fourth blocking plate, and the upper blocking plate is a detachable shielding plate.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

In order to illustrate the technical solution of the invention or prior art more clearly, hereinafter, a brief introduction of accompanying drawings employed in the description of the embodiments or the prior art is provided. It is apparent that accompanying drawings described hereinafter merely are several embodiments of the invention. For one skilled in the art, other drawings can be obtained according to the accompanying drawings, without a creative work.

DETAILED DESCRIPTION OF THE EMBODIMENTS

Embodiments of the invention are described more fully hereinafter with reference to the accompanying drawings, in which preferred embodiments of the invention are shown. The various embodiments of the invention may, however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
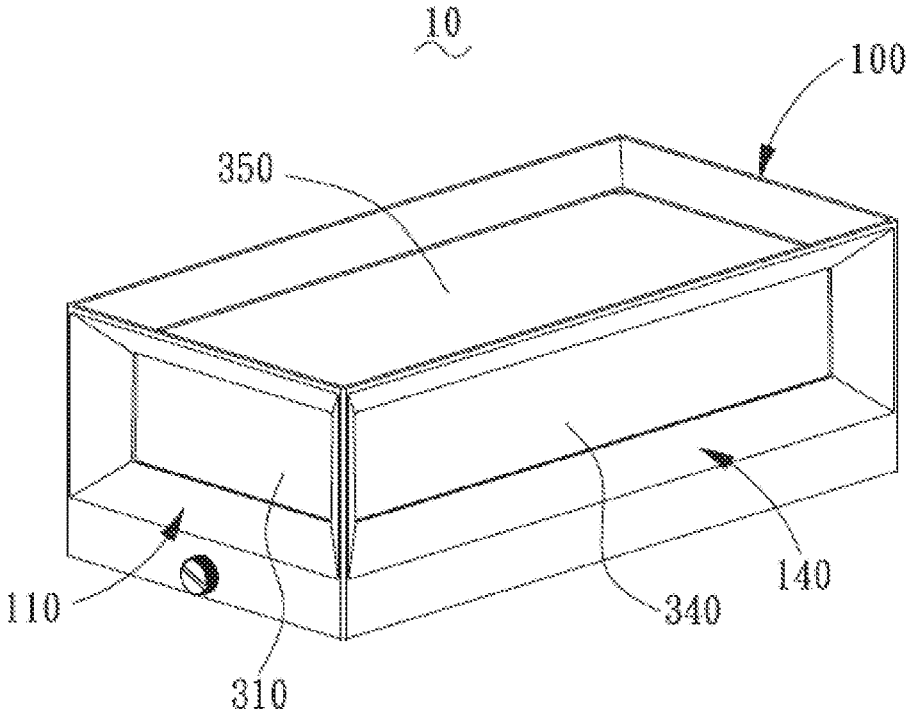
FIG. 1 is a perspective view of a wall lamp according to a preferred embodiment of the invention.
Figure 2:
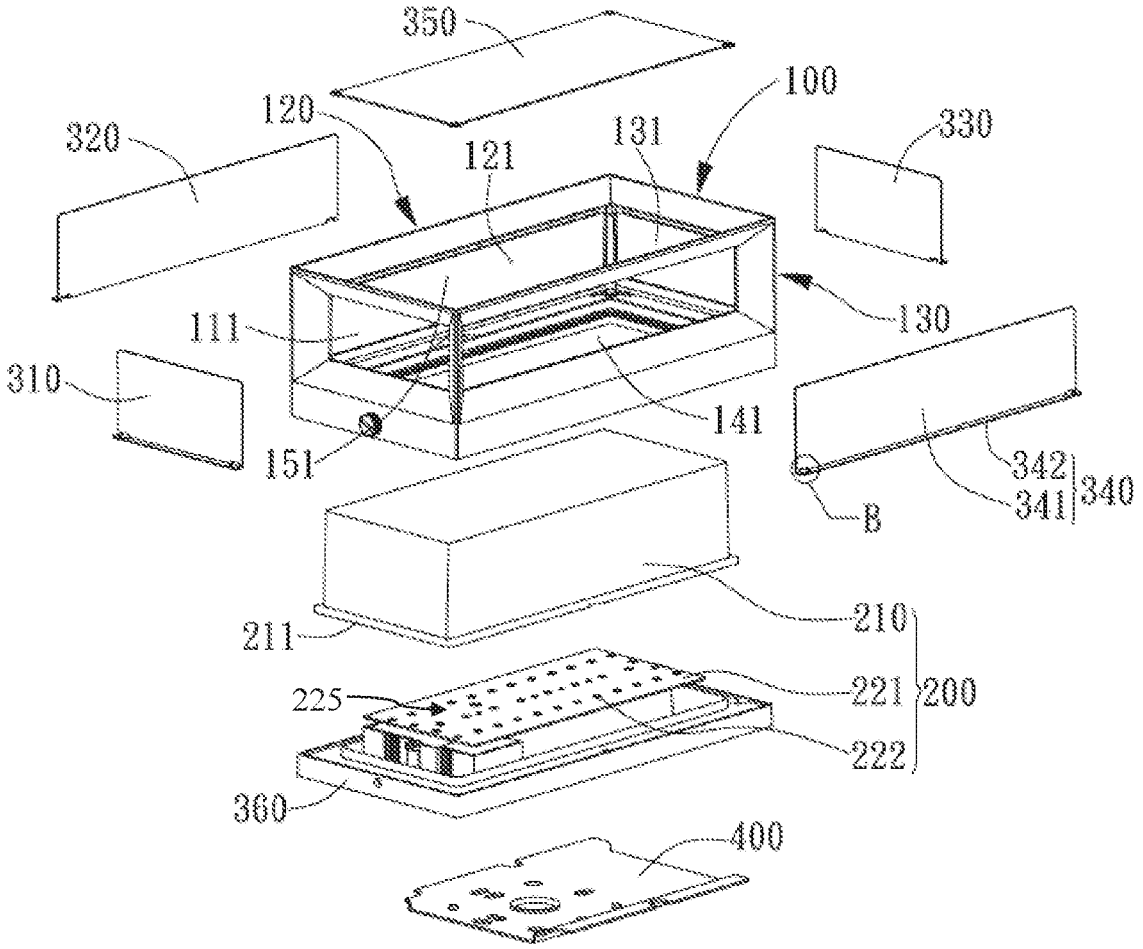
FIG. 2 is an exploded view of the wall lamp of FIG. 1.
Figure 3:
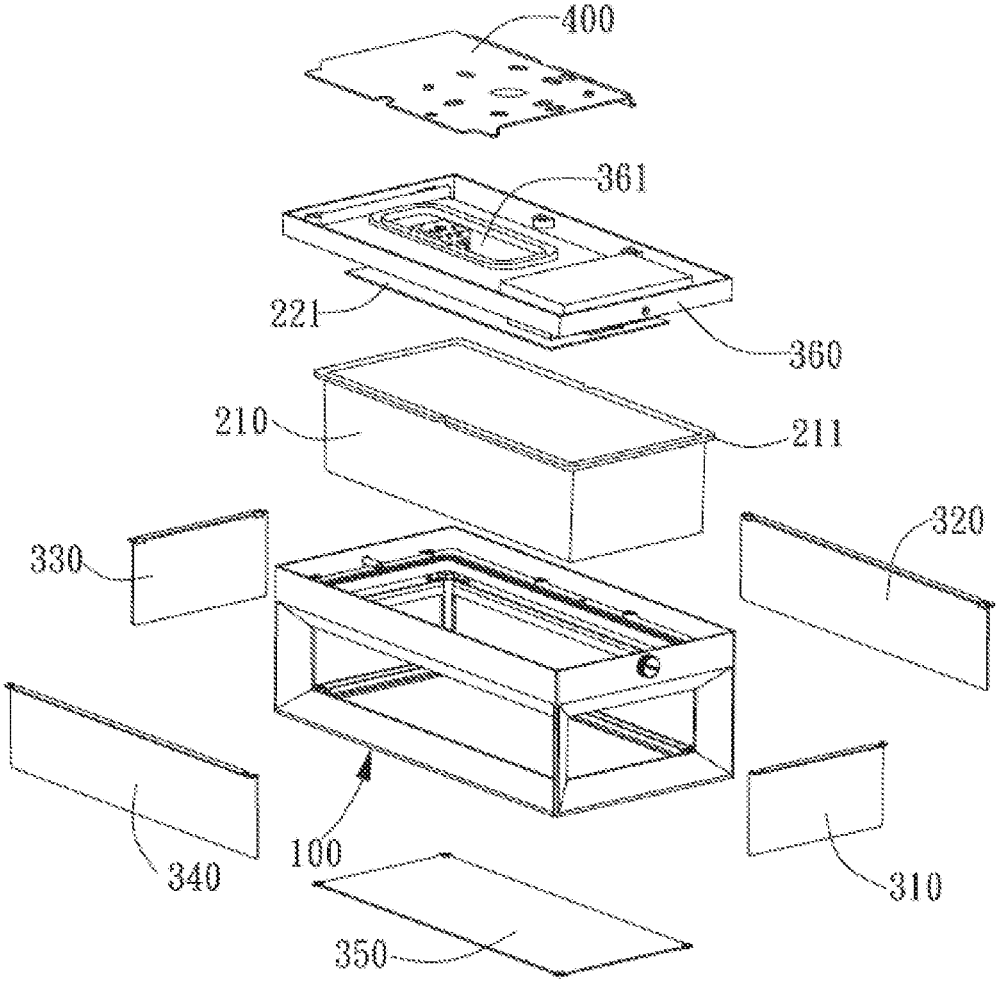
FIG. 3 is similar to FIG. 2, but viewed from another aspect.
Figure 4:
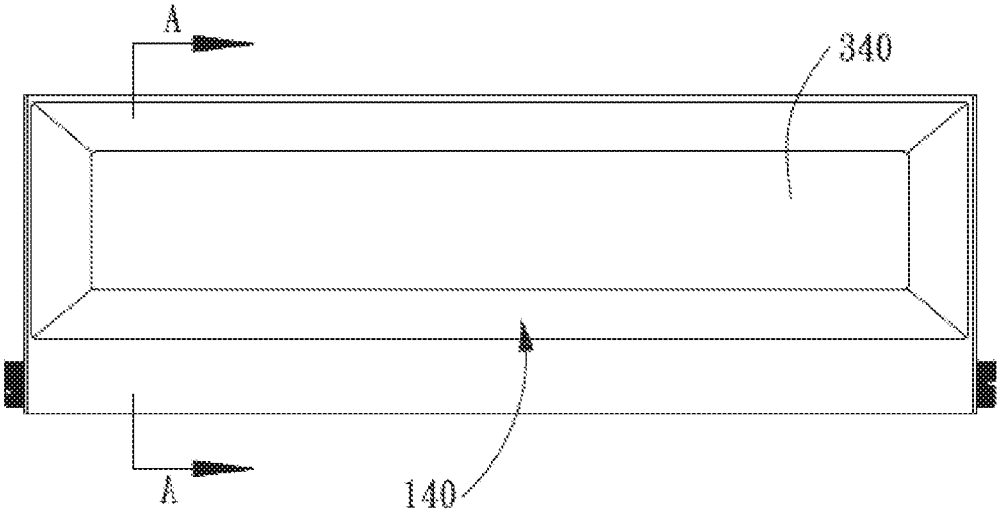
FIG. 4 is a side view of the wall lamp of FIG. 1.
Figure 5:
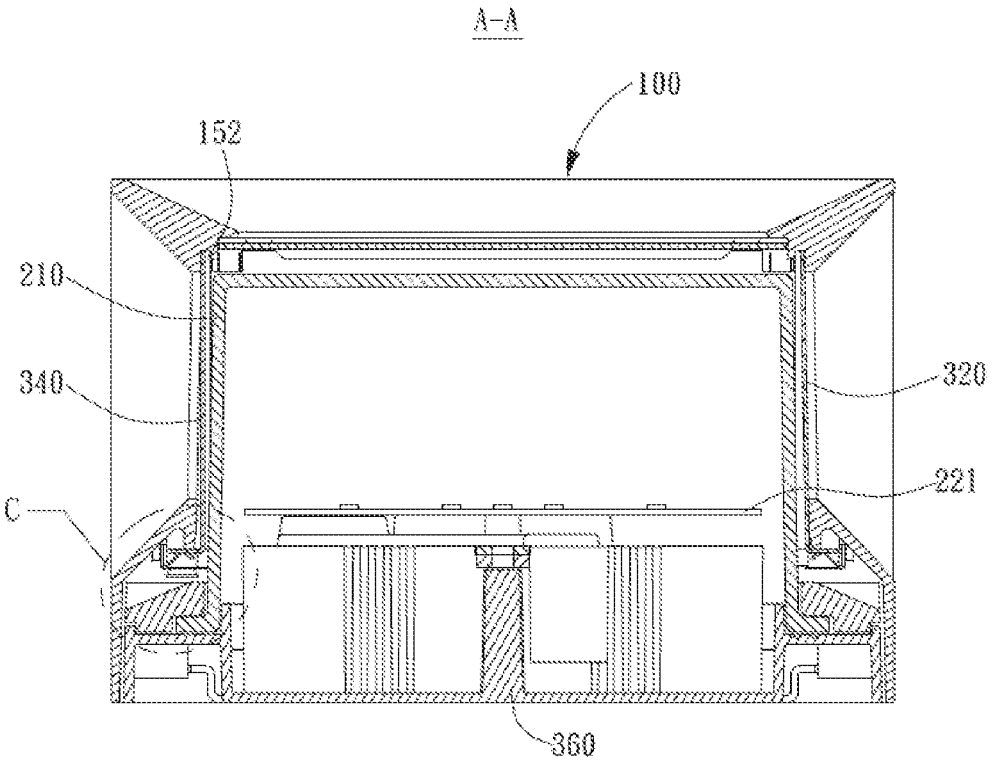
FIG. 5 is cross-sectional view taken along line A-A of FIG. 4.
Figure 6:
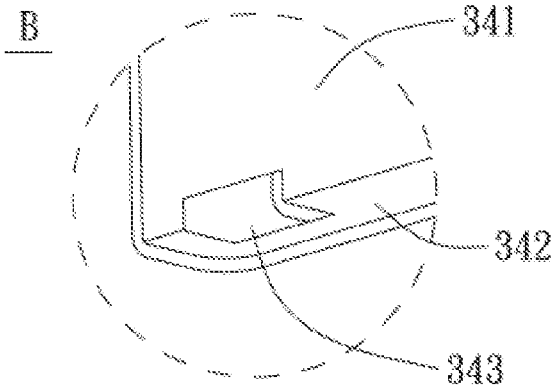
FIG. 6 is an enlarged view of circled portion B of FIG. 2.
Figure 7:
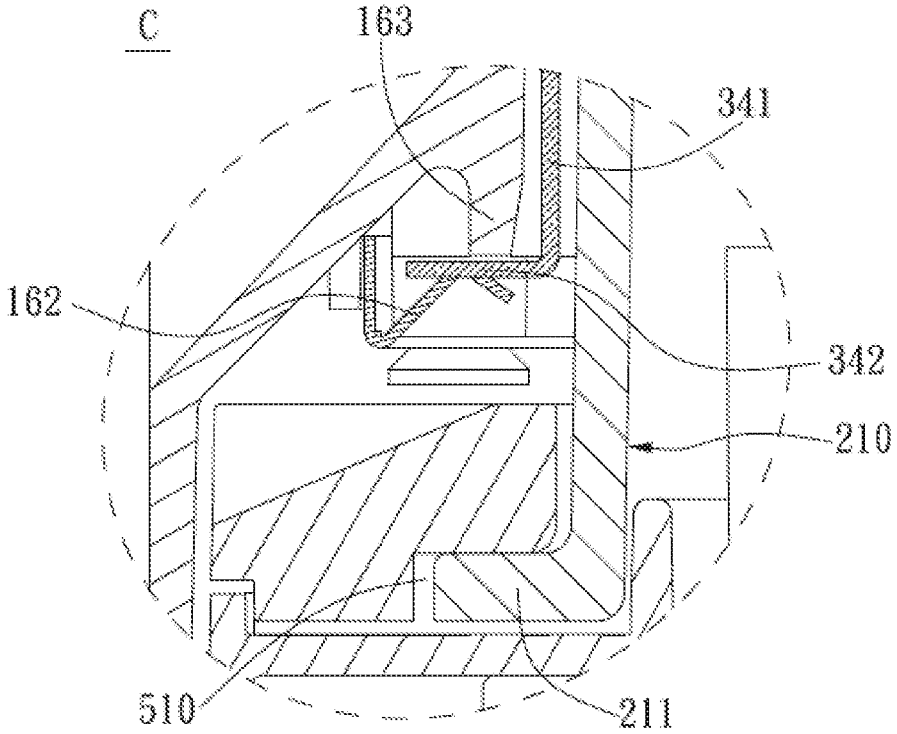
FIG. 7 is an enlarged view of circled portion C of FIG. 5.

As shown in FIG. 1 through FIG. 3, a wall lamp 10 according to an embodiment includes a main frame 100, a luminous component 200 positioned in the main frame 100, a first blocking plate 310, a second blocking plate 320, a third blocking plate 330, and a fourth blocking plate 340 that surround the main frame 100 successively, an upper blocking plate 350 positioned on a top portion of the main frame 100, and a base 360 assembled to a bottom portion of the main frame 100. The main frame 100 includes a first side portion 110, a second side portion 120, a third side portion 130, and a fourth side portion 140 that are connected to each other successively and surround the main frame 100.

The first blocking plate 310, the second blocking plate 320, the third blocking plate 330, and the fourth blocking plate 340 are positioned on the first side portion 110, the second side portion 120, the third side portion 130, and the fourth side portion 140 correspondingly. Specifically, the first side portion 110 defines a first light emitting outlet 111, the first blocking plate 310 is assembled to the first side portion 110, and configured to seal the first light emitting outlet 111; the second side portion 120 defines a second light emitting outlet 121, the second blocking plate 320 is assembled to the second side portion 120, and configured to seal the second light emitting outlet 121, the third side portion 130 defines a first light emitting outlet 131, the third blocking plate 330 is assembled to the third side portion 130, and configured to seal the third light emitting outlet 131; the forth side portion 140 defines a fourth light emitting outlet 141, the fourth blocking plate 340 is assembled to the fourth side portion 140, and configured to seal the fourth light emitting outlet 141. The top portion of the main frame 100 defines a fifth light emitting outlet 151, the upper blocking plate 350 is configured to seal the fifth light emitting outlet 151.

At least one of the first blocking plate 310, the second blocking plate 320, the third blocking plate 330, the fourth blocking plate 340, and the upper blocking plate 350 is a detachable shielding plate, the residual can be detachable transparent plates, or can be transparent plates which are fixed assembled, or can be detachable shielding plates.

In an embodiment, all of the first blocking plate 310, the second blocking plate 320, the third blocking plate 330, the fourth blocking plate 340, and the upper blocking plate 350 are detachable shielding plate. In another embodiment, the upper blocking plate 350 is a transparent plate which is detachably assembled, and the first blocking plate 310, the second blocking plate 320, the third blocking plate 330, and the fourth blocking plate 340 are detachable shielding plates. It should be noted that aforementioned shielding plates can be glass sheets with a lower light transmittance, and also can be opaque plastic sheets or wood sheets. Aforementioned transparent plates can be glass sheets or plastic sheets with a higher light transmittance. Specifically, an edge of the upper blocking plate 350 defines a plurality of assembly holes which are configured for threaded fasteners to extend through to assembly the upper blocking plate 350 to the top portion of the main frame 100.

According to requirements in different scenarios, any one or several of the first blocking plate 310, the second blocking plate 320, the third blocking plate 330, the fourth blocking plate 340, and the upper blocking plate 350 are reasonably configured to adopt a detachably assembly mode or a fixed assembly mode, and is reasonably configured to be a shielding plate or a transparent plate, causing an light emission angle or a light emission direction of the luminous component 200 can be adjusted by virtue of a shifting operation between the shielding plate and the transparent plate.

The luminous component 200 includes a light transmissive lampshade 210 and a light emitting unit 225, the light transmissive lampshade 210 covers the base 360, the light emitting unit 225 is positioned on the base 360 and is received in the light transmissive lampshade 210. The light emitting unit 225 includes a circuit plate 221 and a plurality of LED lamps 222 soldered to the circuit plate 221. The wall lamp 10 further includes a cover plate 400 detachably assembled to the base 360, a bottom portion of the base 360 which is opposite to the light transmissive lampshade 210 defines a containing groove 361, the cover plate 400 seals the containing groove 361, an electronic component is provided in the containing groove 361 and is electrically connected to the circuit plate 221. The electronic component in the containing groove 361 can be repaired or replaced by a disassembly of the cover plate 400.

As shown in FIG. 4 through FIG. 7, in the embodiment, the top portion of the main frame 100 defines a latching groove 152, the bottom portion of the main frame 100 are provided with a plurality of bending buckles 162. An edge of each of the first blocking plate 310, the second blocking plate 320, the third blocking plate 330, and the fourth blocking plate 340 defines a positioning hole for the bending buckle 162 to detachably latch in, the other edge extends into the latching groove 152. Each of the first blocking plate 310, the second blocking plate 320, the third blocking plate 330, and the fourth blocking plate 340 has an L-shaped structure, includes a vertical plate and a lateral plate extending perpendicular to the vertical plate, the positioning hole is defined on the lateral plate, an edge of the vertical plate away from the lateral plate extends into the latching groove 152. The bottom portion of the main frame 100 is provided with a convex edge 163 which is positioned toward the bending buckle 162, when the bending buckle 162 is latched in the positioning hole, the convex edge 163 compresses the lateral plate.

Taking the fourth blocking plate 340 for example, the fourth blocking plate 340 includes a vertical plate 341 and a lateral plate 342 perpendicular to the vertical plate 341. The lateral plate 342 defines a plurality of positioning holes 343, an edge of the vertical plate 341 which is away from the lateral plate 342 extends into the latching groove 152. The bending buckle 162 is latched in the positioning hole 343, to realize a firmly and detachably assembly of the fourth blocking plate 340 to the fourth side portion 140. Further, the bottom portion of the main frame 100 is provided with the convex edge 163 positioned toward the bending buckle 162, the convex edge 163 compresses the lateral plate 342, thus when the bending buckle 162 is latched in the positioning hole 343, the convex edge 163 can limit a shaking of the lateral plate 342. The structures and assembly modes of the first blocking plate 310, the second plate 320, and the third blocking plate 330 can be obtained by referring to the fourth blocking plate 340, and are not specifically described herein.

In the embodiment, an edge of the light transmissive lampshade 210 is bended outwardly to form a bending portion 211, the bending portion 211 extends into a limiting region 510 formed between the base 360 and the main frame 100.

In aforementioned wall lamp 10, by virtue of reasonably configured at least one of the upper blocking plate 350, the first blocking plate 310, the second blocking plate 320, the third blocking plate 330, and the fourth blocking plate 340 to be a detachable shielding plate, a light emission angle or a light emission direction of the luminous component 200 in the main frame 100 can be adjusted, and it meets requirements of different scenarios, thereby obtaining multi-functions and a better flexibility.

The above are several embodiments of the present invention described in detail, and should not be deemed as limitations to the scope of the present invention. It should be noted that variations and improvements will become apparent to those skilled in the art to which the present invention pertains without departing from its spirit and scope. Therefore, the scope of the present invention is defined by the appended claims.

What is claimed is:

1. A wall lamp, comprising:

a main frame comprising a first side portion, a second side portion, a third side portion, and a fourth side portion that are connected to each other successively;

a luminous component located in the main frame;

a first blocking plate, a second blocking plate, a third blocking plate, and a fourth blocking plate positioned on the first side portion, the second side portion, the third side portion, and the fourth side portion, respectively;

an upper blocking plate positioned on a top portion of the main frame; and a base assembled to a bottom portion of the main frame;

wherein at least one of the first blocking plate, the second blocking plate, the third blocking plate, the fourth blocking plate, and the upper blocking plate is a detachable shielding plate.

2. The wall lamp according to claim 1, wherein the first blocking plate, the second blocking plate, the third blocking plate, the fourth blocking plate, and the upper blocking plate are detachable shielding plates.

3. The wall lamp according to claim 1, wherein the luminous component comprises a light transmissive lampshade and a light emitting unit positioned on the base and received in the light transmissive lampshade.

4. The wall lamp according to claim 3, wherein an edge of the light transmissive lampshade is bended outwardly to form a bending portion, the bending portion extends into a limiting region formed between the base and the main frame.

5. The wall lamp according to claim 3, wherein the light emitting unit comprises a circuit plate and a plurality of LED lamps provided on the circuit plate.

6. The wall lamp according to claim 5, further comprising a cover plate detachably assembled to the base, wherein the base defines a containing groove on a bottom thereof opposite to the light transmissive lampshade, the cover plate seals the containing groove, the wall lamp further comprises an electronic component located in the containing groove and electrically connected to the circuit plate.

7. The wall lamp according to claim 1, wherein the upper blocking plate defines a plurality of assembly holes on an edge thereof, through which threaded fasteners can extend to assembly the upper blocking plate to the top portion of the main frame.

8. The wall lamp according to claim 1, wherein the top portion of the main frame defines a latching groove, the bottom portion of the main frame are provided with a plurality of bending buckles, an edge of each of the first blocking plate, the second blocking plate, the third blocking plate, and the fourth blocking plate defines a positioning hole for the bending buckle to detachably latch in, the other edge thereof extends into the latching groove.

9. The wall lamp according to claim 8, wherein each of the first blocking plate, the second blocking plate, the third blocking plate, and the fourth blocking plate has an L-shaped structure, and comprises a vertical plate and a lateral plate extending perpendicular to the vertical plate, the positioning hole is defined on the lateral plate, an edge of the vertical plate away from the lateral plate extends into the latching groove.

10. The wall lamp according to claim 9, wherein the bottom portion of the main frame is provided with a convex edge which is positioned toward the bending buckle, when the bending buckle is latched in the positioning hole, the convex edge compresses the lateral plate.

* * * * *